US008142261B1

(12) United States Patent
Sung

(10) Patent No.: US 8,142,261 B1
(45) Date of Patent: Mar. 27, 2012

(54) METHODS FOR ENHANCING CHEMICAL MECHANICAL POLISHING PAD PROCESSES

(76) Inventor: Chien-Min Sung, Taipei County (TW)

( * ) Notice: Subject to any disclaimer, the term of this patent is extended or adjusted under 35 U.S.C. 154(b) by 0 days.

(21) Appl. No.: 11/606,365

(22) Filed: Nov. 27, 2006

(51) Int. Cl.
*B24B 1/00* (2006.01)

(52) U.S. Cl. ..... 451/56; 451/72

(58) Field of Classification Search ..... 451/5, 8, 451/21, 56, 72, 443, 285–290
See application file for complete search history.

(56) References Cited

U.S. PATENT DOCUMENTS 5,245,790 A * 9/1993 Jerbic ..... 451/159
5,399,234 A 3/1995 Yu et al.
5,522,965 A 6/1996 Chisholm et al.
5,531,861 A 7/1996 Yu et al.
5,683,289 A 11/1997 Hempel, Jr.
5,738,568 A * 4/1998 Jurjevic et al. ..... 451/41
5,834,377 A 11/1998 Chen et al.
5,876,265 A 3/1999 Kojima
5,893,753 A * 4/1999 Hempel, Jr. ..... 438/691
5,904,609 A 5/1999 Fukuroda et al.
5,904,615 A * 5/1999 Jeong et al. ..... 451/443
5,913,714 A 6/1999 Volodarsky et al.
5,938,507 A * 8/1999 Ko et al. ..... 451/56
5,957,754 A 9/1999 Brown et al.
6,045,434 A 4/2000 Fisher, Jr. et al.
6,054,183 A * 4/2000 Zimmer et al. ..... 427/249.8
6,059,636 A 5/2000 Inaba et al.
6,149,505 A 11/2000 Brown et al.
6,153,526 A 11/2000 Shih et al.
6,191,038 B1 2/2001 Yoshida et al.
6,193,001 B1 2/2001 Eyre et al.
6,220,936 B1 4/2001 Quek
6,241,587 B1 6/2001 Drill et al.
6,241,588 B1 6/2001 Brown et al.
6,264,532 B1 7/2001 Meloni
6,270,397 B1 8/2001 Wu
6,325,709 B1 12/2001 Nanda et al.
6,331,136 B1 * 12/2001 Bass et al. ..... 451/56
6,336,851 B1 * 1/2002 Shendon ..... 451/303
6,343,977 B1 2/2002 Peng et al.
6,376,377 B1 4/2002 Chang et al.
6,402,588 B1 6/2002 Matsuo et al.
6,410,877 B1 6/2002 Dixon et al.
6,416,617 B2 7/2002 Yoshida et al.
6,460,552 B1 10/2002 Lorimer
6,494,765 B2 12/2002 Gitis et al.
6,508,258 B1 1/2003 Lorimer
6,508,697 B1 1/2003 Benner et al.
6,517,414 B1 2/2003 Tobin et al.
6,554,688 B2 4/2003 Lacy
6,561,875 B1 5/2003 Homma et al.
6,575,820 B2 6/2003 Lui et al.
6,616,513 B1 9/2003 Osterheld
6,682,396 B1 1/2004 Shih et al.
6,733,363 B2 5/2004 Moore
6,790,497 B2 9/2004 Massa et al.
6,811,468 B2 11/2004 Nobe
6,811,471 B2 11/2004 Beaudoin
6,814,130 B2 11/2004 Sung
6,846,341 B2 1/2005 Middlemiss
6,942,554 B1 * 9/2005 Mandina ..... 451/165
6,976,907 B2 12/2005 Golzarian et al.
7,063,599 B2 * 6/2006 Kramer ..... 451/56
7,089,081 B2 8/2006 Pamgren
7,210,981 B2 5/2007 Yilmaz et al.
7,258,600 B1 * 8/2007 Benner ..... 451/72
7,473,162 B1 1/2009 Sung et al.
7,575,503 B2 * 8/2009 Benner ..... 451/72
7,749,050 B2 7/2010 Sung
2002/0119733 A1 8/2002 Yasui et al.
2003/0166383 A1 9/2003 Kumura et al.
2003/0196385 A1 10/2003 Middlemiss
2005/0121969 A1 * 6/2005 Emesh et al. ..... 301/37.105
2007/0077871 A1 * 4/2007 Park et al. ..... 451/56
2007/0155298 A1 7/2007 Sung
2007/0254558 A1 * 11/2007 Kodera et al. ..... 451/28
2009/0127231 A1 5/2009 Sung

OTHER PUBLICATIONS

Sung et al; Diamond Wear Pattern of CMP Pad Conditioner; VMIC; 2004; 15 pages; Taiwan.
Ming-Yi Tsai et al.; CMP Pad Dressing with Oriented Diamond; VMOC; 2004; 5 pages; Taiwan.

* cited by examiner

*Primary Examiner* — Timothy V Eley
(74) *Attorney, Agent, or Firm* — Thorpe North & Western LLP

(57) ABSTRACT

The present invention discloses a CMP device and methods that are capable of improving CMP processing through incorporation of vibration sources which produce vibrations in a direction substantially parallel to the working surface of the CMP pad. The CMP device includes a CMP pad dresser. Such a method can include steps of vibrating a CMP pad, CMP pad dresser, or wafer in a direction substantially parallel to a working surface of the CMP pad and engaging the CMP pad dresser with a working surface of a CMP pad The results of vibrating the superabrasive particles can provide benefits to both the CMP pad and dresser, according to several aspects disclosed herein.

18 Claims, No Drawings

METHODS FOR ENHANCING CHEMICAL MECHANICAL POLISHING PAD PROCESSES

FIELD OF THE INVENTION

The present invention relates generally to methods and devices for improving chemical mechanical processing. Accordingly, the present invention involves the fields of chemistry, metallurgy, mechanics and materials science.

BACKGROUND OF THE INVENTION

Chemical mechanical process (CMP), also know as chemical mechanical planarization or chemical mechanical polishing, has become a widely used technique for polishing certain work pieces. Particularly, the computer manufacturing industry has begun to rely heavily on CMP processes for polishing wafers of ceramics, silicon, glass, quartz, metals, and mixtures thereof for use in semiconductor fabrication. Such polishing processes generally entail applying the wafer against a rotating pad made from a durable organic substance such as polyurethane. Additionally, a slurry of a chemical solution capable of breaking down the wafer substance, and a sufficient amount of abrasive particles is added to the pad to further aid in the polishing of the wafer surface. The slurry is continually added to the rotating CMP pad, and the dual chemical and mechanical forces exerted on the wafer cause it to polish or planarize in a desired manner.

In a typical polishing process, the working surface of the pad holds the slurry containing the abrasive particles, usually by a mechanism such as fibers, asperities or small grooves, which provide a friction force sufficient to prevent the particles from being thrown off of the pad due to the centrifugal force exerted by the pad's spinning motion. Therefore, it is important to assure that there are an abundance of openings and grooves available on the pad surface to receive new slurry.

A problem with maintaining the working surface of the pad is caused by an accumulation of polishing debris coming from the work piece, abrasive slurry, and dressing disk. This accumulation causes a "glazing" effect, or hardening of the working surface of the pad, and wears or mats the fibers down. Thus, the pad is less able to hold the abrasive particles of the slurry, and the pad's overall polishing performance is significantly decreased. Further, with many pads, the grooves used to hold the slurry become clogged, and the pad's polishing surface becomes depressed and matted. Therefore, attempts have been made to revive the surface of the pad by "grooming" or "cutting" grooves and forming asperities on the surface with various devices. This process has come to be known as "grooming", "dressing" or "conditioning" the CMP pad. Many types of devices and processes have been used for this purpose. One such device is a disk with a plurality of superabrasive particles, such as diamond particles, attached to a surface or substrate thereof.

There have been improvements in CMP pad dresser devices to enhance their conditioning properties and to improve the pad properties. However, these improvements have been met with limited success. For example, the present CMP pad dressers lack the ability to form asperities in the pad surface having uniform heights. Uniformity in asperity height can determine the polishing rate as well as polishing performance. Therefore, CMP pads which contain asperities having uniform height promote polished wafers having more planar surfaces; while pads having asperities that varying in height result in unreliable polishing rates and micro-size wafer surface deformities.

Yet another disadvantage with modern CMP processes is reduced life of the CMP pad and the abrasive particles on the CMP pad dresser. Abrasive particles and CMP pads can wear out prematurely when the particles remove more pad material than is necessary. With the CMP pad and abrasive particles wearing out prematurely, the high polishing rate and quality needed are lost and the ability to revitalize the pad surface is further reduced. In general, the polishing process pulls the abrasive particles through the pad surface while dragging the deformable pad material. Dragging the pad material promotes irregular and unpredictably sized asperities. Additionally, dragging the pad material places undue wear on the abrasive particles and, can cause premature wearing, thereby further creating an unpredictable polishing process.

In view of the foregoing, it is desirable to obtain methods and CMP pad dressers which can optimize CMP pad polishing performance while maximizing efficiency and lifespan of the CMP pad dresser.

SUMMARY OF THE INVENTION

Accordingly, the present invention provides a method that is capable of minimizing a drag coefficient on superabrasive particles. The method can include vibrating a CMP pad, CMP pad dresser, or wafer in a direction substantially parallel to the working surface of the CMP pad while a wafer is being polished. This vibrating takes place while the CMP pad dresser is engaging the CMP pad. In most cases, vibration of the entire dresser will provide the requisite vibration to the superabrasive particles. Vibrating the superabrasive particles can result in CMP pad asperities which have substantially uniform heights, and CMP pad troughs or grooves having substantially uniform depths. Notably, CMP pads possessing such properties can have more predictable polishing rates and can promote higher quality polished wafers. Other benefits derived from such a method are CMP pads and superabrasive particles with an extended service life.

In another embodiment, the present invention includes a CMP pad dresser device having a plurality of superabrasive particles coupled to a working surface of a CMP pad dresser substrate and at least one vibrator coupled to the CMP pad dresser at a location that is capable of vibrating the dresser and particles in a motion that is substantially parallel to the working surface of the CMP pad with which the CMP pad dresser is engaged. In alternative embodiments, multiple vibrators may be coupled to the CMP pad dresser to provide a vibration that is sufficient to create uniform asperity heights and uniform trough depths. Additionally, there are many vibrators which may be coupled to the CMP pad dresser, one such vibrator is a piezoelectric ultrasonic transducer. Utilizing such a device can also provide the ability to control the ultrasonic rate of vibration by altering the frequency and amplitude of the vibrational waves, thereby allowing a user to fine tune the device for specific polishing materials and/or applications.

There has thus been outlined, rather broadly, the more important features of the invention so that the detailed description thereof that follows may be better understood, and so that the present contribution to the art may be better appreciated. Other features of the present invention will become clearer from the following detailed description of the invention, or may be learned by the practice of the invention.

DETAILED DESCRIPTION OF THE INVENTION

Before the present CMP pad dresser and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to an "abrasive particle" or a "grit" includes reference to one or more of such abrasive particles or grits.

DEFINITIONS

In describing and claiming the present invention, the following terminology will be used in accordance with the definitions set forth below.

As used herein, "abrasive particle," or "grit," or similar phrases mean any super hard crystalline, or polycrystalline substance, or mixture of substances and include but are not limited to diamond, polycrystalline diamond (PCD), cubic boron nitride (cBN), and polycrystalline cubic boron nitride (PCBN). Further, the terms "abrasive particle," "grit," "diamond,". "polycrystalline diamond (PCD)," "cubic boron nitride (cBN)" and "polycrystalline cubic boron nitride, (PCBN)," may be used interchangeably.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "vibrate" means to oscillate an object in a substantially horizontal direction, back and forth or from side to side, in a rapid movement. Vibrations may be continuous, intermittent, continuously variable, in accordance with a vibrational program, etc. Accordingly, a CMP pad, CMP pad dresser, wafer, or superabrasive particles of a CMP pad dresser can be vibrated at a desired frequency to obtain an optimal polishing performance.

As used herein, "ultrasonic" means any energy wave that vibrates with frequencies higher than those audible to the human ear. For example such frequencies are higher frequencies than about 15,000 Hz, or in other words more than about 15,000 cycles per second.

As used herein, "substrate" means a portion of a CMP dresser which supports abrasive particles, and to which abrasive particles may be affixed. Substrates useful in the present invention may be any shape, thickness, or material, which is capable of supporting abrasive particles in a manner that is sufficient to provide a tool useful for its intended purpose. Substrates may be of a solid material, a powdered material that becomes solid when processed, or a flexible material. Examples of typical substrate materials include without limitation, metals, metal alloys, ceramics, and mixtures thereof. Further, the substrate may include brazing alloy material.

As used herein, "quality" means a degree or grade of excellence. Each characteristic or property of a superabrasive particle such as internal crystalline perfection, shape, etc. may be ranked in order to determine the quality of the particle. A number of established quality scales exist in the area of diamonds and other superabrasives, such as the Gemological Institute of America (GIA) Diamond Grading Report or the GIA Scale, which will be well recognized by those of ordinary skill in the art.

As used herein, "amorphous braze" refers to a homogenous braze composition having a non-crystalline structure. Such alloys contain substantially no eutectic phases that melt incongruently when heated. Although precise alloy composition is difficult to ensure, the amorphous brazing alloy as used herein should exhibit a substantially congruent melting behavior over a narrow temperature range.

As used herein, "alloy" refers to a solid or liquid mixture of a metal with a second material, said second material may be a non-metal, such as carbon, a metal, or an alloy which enhances or improves the properties of the metal.

As used herein, "metal brazing alloy," "brazing alloy," "braze alloy," "braze material," and "braze," may be used interchangeably, and refer to a metal alloy which is capable of chemically bonding to superabrasive particles, and to a matrix support material, or substrate, so as to substantially bind the two together. The particular braze alloy components and compositions disclosed herein are not limited to the particular embodiment disclosed in conjunction therewith, but may be used in any of the embodiments of the present invention disclosed herein.

As used herein, the process of "brazing" is intended to refer to the creation of chemical bonds between the carbon atoms of the superabrasive particles and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not require the presence of a carbide former.

As used herein, "chemical bond" and "chemical bonding" may be used interchangeably, and refer to a molecular bond that exerts an attractive force between atoms that is sufficiently strong to create a binary solid compound at an interface between the atoms.

As used herein, in conjunction with the brazing process, "directly" is intended to identify the formation of a chemical bond between the superabrasive particles and the identified material using a single brazing metal or alloy as the bonding medium.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, silicon carbides, tungsten carbides, etc.

As used herein, "metallic" means any type of metal, metal alloy, or mixture thereof, and specifically includes but is not limited to steel, iron, and stainless steel.

As used herein, "grid" means a pattern of lines forming multiple squares.

As used herein, with respect to superabrasive particle placement, distances, and sizes, "uniform" refers to dimensions that differ by less than about 75 total micrometers.

As used herein, "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, the term "about" is used to provide flexibility to a numerical range endpoint by providing that a given value may be "a little above" or "a little below" the endpoint.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a concentration range of 1 to 5 should be interpreted to include not only the explicitly recited limits of 1 and 5, but also to include individual values such as 2, 7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10".

The Invention

Vibrating the components involved in a materials removal process has been found to provide many benefits. Vibrating can provide a re-distribution of force between a tool and a work piece from which material is being removed, thus reducing the directional force of the tool against a work piece. As a result, addition of a vibrating element to some tools allows the same work to be performed with overall lower force and a lower and redistribution of traditional directional forces. Additionally, vibrations may have a beneficial effect on particle movement, particularly in sieving operations in that powder is less prone to plug sieves if there is a vibrational aspect to the process. Ultrasonic vibrations, in particular, have been known to greatly improve the efficacy of such processes as facial cleansing and polishing teeth. Regarding CMP processing, vibrating the system in general can offer many benefits. One such benefit is extended dresser life. Another benefit is lower stress polishing, which can greatly improve the polishing process particularly with regard to certain polishing processes. Furthermore, reduced deformation of materials at the interface between the dresser and work piece allows improved accuracy and allows operations on softer and more delicate materials not typically suitable for being worked on by traditional tools. Soft copper circuitry and fragile items that require polishing (i.e. 65 nm or smaller interconnects) can greatly benefit from a vibrational aspect to polishing in that the polishing can be carried out at high speed but low stress to the polished item, thus efficiently producing a better product.

With these principles in mind, the present invention provides methods for improving CMP processing. One embodiment includes minimizing drag coefficient on superabrasive particles of a CMP pad dresser and associated devices. The inventors have found that certain vibrations imparted to abrasive particles of a CMP dresser during routine conditioning cycles can reduce the drag coefficient imparted on the superabrasive particles which may result in many benefits to the CMP pad and dresser itself. For example, a reduced drag coefficient may create CMP pad asperities having substantially uniform heights and CMP pad troughs or grooves having substantially uniform depths. Additionally, the inventors have discovered that CMP pads possessing such properties can have more predictable polishing rates and can promote higher quality polished wafers. Other benefits derived from reduced drag coefficients are CMP pads having an extended service life and reduced wear on the superabrasive particles.

Vibrating the CMP apparatus (including any portion of the CMP pad, CMP pad dresser, or wafer), also reduces stick-slip of the materials. That is to say that vibrating the pad, dresser, and/or wafer reduces the direct and potentially harmful contact that they have upon contacting each other. Often, materials have a tendency to stick on each other (due to the forces of friction) and then slip. In most applications of movement, this effect is not detrimental, damaging or even a hindrance, however, in dealing with materials with such a tight tolerance for thickness and surface variance, these stick-slip effects can be very damaging. Including a vibrational aspect to CMP allows for more efficient polishing and dressing. There will be less tearing and deformation in both processes due to the reduced stick-slip. This is particularly important to avoid destruction and damage to low K dielectric and soft copper circuitry. The efficiency of the process is further improved by the vibrating in that the consumption of slurry, if used at all, can be reduced. The vibrating allows for the slurry particles to be used many more times before it is dislodged, again as a result of the reduced stick-slip.

As discussed above, CMP pads are typically comprised from a urethane type material that planarizes wafers by polishing them against a rotating CMP pad disc. After several cycles of wafer polishing, a CMP pad dresser must be used to reduce or prevent the working surface of the CMP pad from glazing. Conversely, a CMP pad dresser typically includes a shaft and a rigid and durable substrate having superabrasive particles attached to an exposed surface of the substrate. There are many different methods for fabricating a CMP pad dresser. Pad dressers may be a slurry-based or a fixed-abrasive type, distinguished by the location of abrasive particles. In the slurry-based type pads, the particles are in a slurry added to the pad. Alternatively, in fixed-abrasive type pads, the particles are attached to the pad's substrate. Surry is optional in fixed-abrasive pads. There are various methods for attaching superabrasive particles to the working surface of the substrate. Such methods and CMP pad devices are described in U.S. Pat. Nos. 6,286,498, 6,679,243, and 6,884,155, and U.S. patent application Ser. Nos. 10/259,168 and 11/026,544, which are incorporated herein by reference in their entirety.

All types of pad dressers are considered applicable to the present invention. This includes fixed-abrasive and slurry-based pads. Fixed-abrasive pads may include any known in the art, including brazed and electroplated. With fixed-abrasive pads, typically, the substrate has an exposed surface upon which the superabrasive particles are to be affixed and may be substantially flat or contoured. The substrate is generally comprised of a metallic material. The substrate may include a variety of metallic materials. Examples of specific metals include without limitation, cobalt, nickel, iron, copper, carbon, and their alloys or mixtures (e.g. tungsten or its carbide, steel, stainless steel, bronze, etc). The superabrasive particles can be brazed or sintered to the exposed surface of the substrate. Alternatively, the particles can be temporarily attached to the exposed surface prior to brazing the superabrasive particles thereto. In another embodiment, the substrate can be an organic material suitable for having superabrasive particles coupled thereto. Such a substrate can include superabrasive particles embedded in a resin layer and a metallic layer disposed between the particles and the resin layer. This type of configuration may be desirable in certain working environments where it is highly desirable or even critical to avoid contaminating a work piece with metals.

There are various processes that can be used to attach or braze the superabrasive particles to the substrate surface. For example, microwave brazing, vacuum brazing and electroplating. For a brazing process, a template having apertures can be placed upon a sheet of brazing alloy. In one aspect of the present invention, the sheet may be a rolled sheet of continuous amorphous brazing alloy. The use of the template allows controlled placement of each abrasive particle at a specific location by designing the template with apertures in a desired pattern. The desired pattern can be a grid. A desired uniform pattern such as a grid can allow for proper spacing between each particle. Accordingly, uniform spacing can improve the conditioning performance of the CMP pad dresser by evenly distributing the workload across all of the particles. After the template is placed on the brazing alloy sheet, the apertures can be filled with superabrasive particles. The superabrasive particles can have a predetermined shape, such as a euhedral, octahedral or cubo-octahedral. Generally, the apertures have a predetermined size, so that only one abrasive particle will fit in each. Any size of abrasive particle or grit is acceptable, however in one aspect of the invention, the particle sizes may be from about 100 to about 350 micrometers in diameter. In another aspect of the invention, the size of the apertures in the template may be customized in order to obtain a pattern of abrasive particles having a size within a uniform size range.

A second method for affixing the superabrasive particles to a substrate can be pressing the superabrasive particles into the brazing alloy sheet. They may be fixed in the templated position by disposing an adhesive on the surface of the brazing alloy sheet. In this manner, the particles remain fixed in place when the template is removed and during heat processing. Attaching the superabrasive particles in this manner allows for proper depth placement in the substrate such that the superabrasive particles extend to a predetermined height above the substrate member. In yet another embodiment of the present invention, the template may be laid upon a transfer sheet having a thin adhesive film thereon. In this case, the particles become adhered to the transfer sheet using the template procedure specified above. The template is then removed, and the transfer sheet is laid onto the brazing sheet with abrasive particles facing the sheet. Disposed upon the brazing sheet is the aforementioned adhesive layer, which is more strongly adhesive than the adhesive on the transfer sheet. Therefore, the abrasive particles are transferred to the sheet of brazing alloy in the pattern dictated by the template.

Similarly, the transfer sheet may use strategically placed adhesive droplets instead of a thin adhesive film or layer. This embodiment can reduce the amount of adhesive contaminates that become incorporated in the brazing process. Additionally, strategically or uniformly placing the droplets in a predetermined pattern removes the need for using a template having apertures as described above. Each adhesive droplet has sufficient strength to adhere a single abrasive particle to each droplet until the particles can be transferred to the brazing sheet. A more detailed description of this process can be found in Applicant's copending application Ser. No. 11/588,839, filed on Oct. 26, 2006, which is incorporated herein by reference in its entirety.

Finally, the abrasive particles may be coupled to a substrate that is made of metallic powders. The metallic powders may be selected from a number of materials known for forming a substrate. Further, the metallic powder may contain brazing alloys to facilitate the brazing the abrasive particles. In a preprocess step, in forming a substrate, the abrasive particles are disposed into the metallic powder prior to solidification or consolidation of the metallic powders. During the brazing or a consolidation step, the abrasive particles are chemically bonded to the substrate, providing a durable CMP pad dresser which may be less vulnerable to particle chipping and dislodging. Those of ordinary skill in the art will understand a number of variations on the above-recited general mechanism, and all mechanisms for making CMP pad dressers are considered to be within the scope of the present invention.

The superabrasive materials that are suitable for a CMP pad dresser, as disclosed herein, can be any natural or synthetic diamond, super hard crystalline, or polycrystalline substance, or mixture of substances and include but are not limited to diamond, diamond-like carbon, polycrystalline diamond (PCD), cubic boron nitride (cBN), and polycrystalline cubic boron nitride (PCBN). As previously noted, the size of the particles can vary but may be from about 100 to about 350 micrometers in diameter.

As mentioned, during a typical CMP pad polishing process a wafer is pressed against a deformable polyurethane CMP pad. As the pad rotates a chemical slurry containing micro-sized abrasive grits impregnates into the grooves and asperities of the CMP pad to aid in the planarization of the wafer. Notably, the highest asperities protruding from the CMP pad surface will make the initial contact with the wafer and will continually polish the wafer surface throughout the polishing process. During the wafer polishing process, both the wafer and the CMP pad begin to wear. Specifically, the CMP pad asperities that bear the initial contact of the wafer will begin to wear more rapidly than the other asperities, thereby creating a CMP pad and polished wafer that varies in thickness and irregularities.

It has now been discovered by the inventors that reducing the drag coefficients on CMP pad dresser abrasive particles can produce CMP pads having uniform asperities which promote higher quality polished wafers, longer CMP pad service life, predictable polishing rates and reduced wear on the superabrasive particles of the CMP pad dresser. Therefore, emphasis has been placed on developing methods and devices that can reduce the drag coefficient on the particles such that uniform asperities and uniform grooves in CMP pad working surfaces can be created.

Traditionally, CMP pad asperities are formed as superabrasive particles cut and plow through the CMP pad while the dresser rotates in a circular motion and traverses the working surface of the pad, thereby removing debris from the pad and rejuvenating the asperities of the working surface of the pad. Much of the cutting and plowing is accomplished by dragging the particles through the deformable polyurethane material. Such dragging can promote inconsistent, irregular and unpredictable sizes in asperities. Therefore, it can be desirous to reduce the dragging effect such that asperities having uniform heights and depths can be obtained.

In an embodiment, reducing the effects of drag or drag coefficients on the superabrasive particles can be accomplished through vibrations imparted onto the dresser and more specifically onto the superabrasive particles of the dresser during the grooming process. The vibrational movements of the particles have been found to be effective at improving the wear on the particles as well as improving the rejuvenated properties of a CMP pad. Functionally, the vibrations can reduce the amount of pad material and frequency that the material comes into contact with the superabrasive particles. As the superabrasive particles vibrate at ultrasonic rates and cut into the CMP pad, a consistent portion of material can be displaced on both sides of the superabrasive particles thereby creating uniform heights in asperities to promote uniform polishing of wafers. Additionally, a minimized drag coefficient can reduce the wear on and extend the service life of the superabrasive particles by limiting the amount of contact with the CMP pad material during a grooming process.

Accordingly, a method that reduces drag coefficients on CMP pad particles can create CMP pad asperities having substantially uniform heights and troughs having uniform depths. The uniform heights and depths can be created by the specific vibrations imparted on the dresser particles. Specifically, the particles can vibrate in either a lateral, circular, elliptical, or any random motion that is substantially parallel to the working surface of the CMP pad. In one aspect of the present invention, the particles are vibrated laterally, i.e. side to side, such that the dragging is reduced since the amount of pad contacted is reduced. It has also been discovered that the amount of drag is significantly reduced when the particles vibrate substantially parallel to the working surface of the CMP pad, instead of vibrating perpendicularly or vertically to the working surface of the pad. As a result, many benefits to the CMP pad and dresser can be obtained, such as uniform and minimal asperity sizes.

Forming the uniform asperity sizes can be accomplished by using a CMP pad dresser claimed by the present invention as compared to typical grooming devices. As the material is constantly displaced by the cutting and plowing of the CMP pad dresser, the vibrational movements of the particles minimize the amount of material that is actually dragged by each superabrasive particle and therefore reduces the overall size of the asperities. Alternatively, as mentioned previously, forming asperities having uniform depths can be accomplished by utilizing a CMP pad dresser having superabrasive particles that extend to a predetermined height above the substrate member such that the depth of the troughs created correspond to the predetermined height of the particles. In such embodiments, the total amount of deformable pad material that is removed can be maintained at a minimum by way of a consistent grooming process, as provided. With this in mind, the service life of the CMP pad can be extended because the pad itself does not have to be replaced as often due to the reduced amount of material removed from the CMP pad.

Minimal and uniform asperity sizes formed from superabrasive particles having a reduced drag coefficient can evenly distribute the workload of the CMP pad which, as a result, can also extend the service life of the CMP pad. For example, it has been determined that the workload distribution on each asperity determines the polishing rate as well as the uniformity or planarity of the polished wafer. If the asperity heights become irregular and vary in height, the initial contact asperities will be few. As the polishing process continues, more asperities will contact the wafer surface, resulting in a decrease in contact pressure and a reduced polishing rate. The contact pressure can actually dictates the polishing rate for each asperity. In other words, wafer contact with few asperities will result in a higher pressure on each asperity and a higher polishing rate because fewer asperities do not have as much surface area to slow the polishing rate. Further, wafer contact with few asperities can be unstable; the polishing rate will decrease rapidly as more contacts are being formed. On the other hand, if superabrasive grits can form asperities with more uniform heights, the polishing rate can be more sustainable because more contact points promote a more uniformed polishing process resulting in higher quality finished wafers. Therefore, the more asperities that come into contact with the wafer at the commencement of the polishing process, the longer the polyurethane pad will last.

Vibrators, or a source of vibration, may be located at various locations on the CMP apparatus. The vibrator may be attached to the CMP pad at any location that can produce oscillations in a direction substantially parallel to the working surface of the CMP pad. Examples include attachment or coupling to the side or periphery of the CMP pad, attachment to any portion of the underside of the CMP pad (i.e. the pad substrate that is the opposite side of the working surface, attachment to the side of the CMP pad, inclusion in any feature attached to the CMP pad (i.e. shafts, backings), etc. Likewise, attachments to the CMP pad dresser may be to the side of the substrate, periphery of the working surface, on the underside of the dresser, in a shaft or other encasement, etc. Attachment to the wafer is possible through the instrument attached to the wafer (such as the retainer ring), or to the wafer directly, via any method known in the art.

In the present invention, the CMP pad dresser or CMP pad can have at least one vibrator coupled to the dresser at a location that vibrates the dresser in a direction substantially parallel to a working surface of the CMP pad with which the CMP pad dresser is engaged. One vibrator can be coupled to the CMP pad dresser, although multiple vibrators may be needed to obtain the proper vibration of the superabrasive particles. With the use of a vibrator, the vibrator can impart vibrations on the superabrasive particles of the CMP pad dresser, which in turn can reduce the drag coefficient. The vibrator may be of any type capable of producing the herein outlined beneficial vibrations. Any electro/mechanical actuation system may be utilized to produce the desired vibrations. In accordance with one aspect of the present invention, the vibrator may be an ultrasonic transducer comprised of a piezoelectric material. Alternatively, the vibrator may be a solenoid with coils of conducting wire. These embodiments are in no wise limiting; other vibrator means may be employed. In another embodiment, multiple vibrators such as ultrasonic transducers, solenoids, or combinations thereof, can be coupled to the dresser at locations that vibrate the dresser and the particles in a direction that is substantially parallel to the working surface of the CMP pad. The vibration may be directionally focused or diffused. Additionally, the vibrations may be amplified by an amplifier or dampened with a damping plate such as an acrylic board. In some aspects, the vibration may be directionally controlled, including back and forth directions, circular, square, figure eight, rectangle, triangle, and other simple or complex directional vibration movements and patterns may be used.

More than one vibrator may be used. In one embodiment, the vibrators may be designed to produce a symmetrical vibration, thus achieving resonance. In another embodiment, the vibrations from multiple sources can be asymmetrical, thus causing variation across the pad and/or wafer. This can be favorable in the case where a portion of the pad is least consumed, thus the vibrations may be intensified in that area so that the pad profile will have the effect of being flat. Such a design can balance pad usage and is useful to achieve a more uniform thickness or flatter surface of the wafer.

The frequency of the present invention may range from about 1 KHz to about 1000 KHz. The power range may be from about 1 W to about 1000 W. As previously mentioned, the vibrations imparted on the superabrasive particles of the CMP pad dresser originate from a vibrator or a vibration means such as piezoelectric transducers. In use, the CMP pad dresser or CMP pad can vibrate in either a lateral, circular, elliptical, or random motion substantially parallel to the working surface of the CMP pad in addition to the afore mentioned directions. Alternatively, the vibration may be completely in a direction parallel to the working surface of the CMP pad. The piezoelectric transducers should be suitable to vibrate the particles at ultrasonic frequencies greater than 15 kHz. Typically, frequencies higher than those audible to the human ear, i.e. more than about 15,000 cycles per second, are considered ultrasonic. In one embodiment the vibrator can oscillate the particles at a frequency of about 20 kHz.

In a further embodiment, the ultrasonic vibrations may greatly improve the process by dispersing slurry particles on the CMP pad. Slurry particles, either those present as part of a slurry to aid in the CMP process, or particles that have been removed from the objects being polished, have a tendency to adversely affect the polishing process. These particles may build up on portions of the CMP pad and scratch the object being polished, e.g. the wafer. Ultrasonic vibrations can disperse the slurry particles and provide a mechanism for more efficient removal of glazed materials and debris.

In another embodiment of the present invention, the vibrator can be adjusted to control the vibrational movements of the superabrasive particles, as well as the drag coefficient of each particle to obtain an optimal polishing experience. Controlling or adjusting either vibration frequency, amplitude or both of the ultrasonic wavelengths can alter the polishing performance for a given CMP pad dresser. Specifically, higher frequencies can produce asperities having higher ridges and/or deeper troughs. Alternatively, increasing the amplitude of the ultrasonic vibrations can also affect the asperity sizes, which can produce asperities that allow for more slurry to penetrate in to the pad surface thereby increasing the overall polishing performance of the system. In reality, controlling the vibrational frequency and amplitude alters the drag coefficient on each grooming superabrasive particle which alters the size of each asperity. Such an embodiment can be conducive for obtaining optimal polishing performance for various applications. For example, increasing the frequency and reducing the amplitude may be needed for optimal polishing of oxide layers on a more brittle wafer. On the other hand, reducing the frequency and increasing the amplitude of the vibrations can be more effective at polishing metal layers (e.g. copper circuit) on a wafer. Further, controlling the vibrational properties may be necessary when other polyurethane-type materials are used form a CMP pad that reacts differently under the pad dressing process.

In one embodiment, the vibrating can be continuous or interrupted. Additionally, the vibrating can be performed as part of a plurality of steps, or a program wherein different vibrational parameters are selected at specific times during the polishing process. The vibrational parameters include, without limitation, frequency, amplitude, and source. In general, large amplitude can cause faster removal but with higher likelihood of damage, while high frequency at low amplitude can polish slower but with better finish. Therefore, it logically follows that a polishing program that starts at a large amplitude and then changes to a high frequency low amplitude vibration can be very beneficial in producing a polished material in faster time, and with better finish than polishing with at a single set of vibrational parameters. The program can change continuously, e.g. changing from a large amplitude to a slow amplitude over time, or there may be different and distinct stages, e.g. changing from a large amplitude immediately to a slow amplitude, either with or without a time pause between changing.

By way of another example, with the case of removal of copper, the CMP process can be controlled for fast removal initially by high amplitude low frequency while the copper surface is rough and then it can be ramped down to high frequency low amplitude when the end point is approaching such as when the barrier layer of tantalum nitride is exposed beneath the copper layer. Furthermore, the vibrational parameters can be modified in accordance to tune to specific conditions, such as addition of slurry, slurry viscosity, new wafer, different wafer-types, new or different pad conditioners or dressers, and other variables that reflect changing pad conditions.

In another embodiment, the vibrations may cause the temperature of at least a portion of the CMP pad to increase by at least about 5° C. In another embodiment, the temperature may increase by at least about 20° C.

The following examples present various methods and device and the effects of reducing the drag coefficient on superabrasive particles during a CMP pad conditioning process. Such examples are illustrative only, and no limitation on present invention is meant thereby.

EXAMPLES

Example 1

An ultrasonic transducer is attached to the side of a typical CMP pad dresser. Side meaning on the CMP pad dresser which has an outer wall that is substantially perpendicular to the working surface of the related CMP pad. The transducer is attached to this side at a location that is not directly in contact with the working surface of the CMP pad dresser. When the CMP pad is in use, the CMP dresser can engage the pad, and condition it while vibrating in a direction substantially parallel to the working surface of the CMP pad.

Example 2

An ultrasonic transducer can be attached to the side of a CMP pad. The location and meaning of side is consistent with that of Example 1. When the pad is in use, the CMP dresser can engage the pad and the vibrations can improve the CMP process.

The above description and examples are intended only to illustrate certain potential embodiments of this invention. It will be readily understood by those skilled in the art that the present invention is susceptible of a broad utility and applications. Many embodiments and adaptations of the present invention other than those herein described, as well as many variations, modifications and equivalent arrangements will be apparent from or reasonably suggested by the present invention and the forgoing description thereof without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise to exclude any such other embodiment, adaptations, variations, modifications and equivalent arrangements, the present invention being limited only by the claims appended hereto and the equivalents thereof.

What is claimed is:

1. A method of minimizing a drag coefficient on superabrasive particles of a CMP pad dresser during a CMP pad conditioning process, comprising:

rotating a CMP pad dresser in a circular motion relative to a CMP pad;

vibrating the CMP pad in a direction substantially parallel to a working surface of the CMP pad at a frequency of at least about 1 KHz while rotating the CMP pad dresser; and engaging the CMP pad dresser with the working surface of the CMP pad such that vibration between the CMP pad dresser and the CMP pad occurs in a direction substantially parallel to the working surface of the CMP pad, wherein the vibration reduces frictional forces between the CMP pad dresser and the CMP pad.

2. The method of claim 1, wherein minimizing drag coefficient creates CMP pad asperities having substantially uniform heights.

3. The method of claim 2, wherein the uniform asperity height evens workload distribution, thereby extending CMP pad service life.

4. The method of claim 2, wherein the uniform asperity height promotes uniform polishing of the wafer being polished by the CMP pad.

5. The method of claim 1, wherein minimizing drag coefficient creates CMP pad troughs having substantially uniform depths.

6. The method of claim 1, wherein minimizing the drag coefficient minimizes CMP pad asperity size.

7. The method of claim 1, wherein minimizing the drag coefficient minimizes removal of CMP pad material.

8. The method of claim 1, wherein minimizing the drag coefficient reduces wear on superabrasive particles.

9. The method of claim 1, wherein the vibration is in a lateral, circular, elliptical, or random motion substantially parallel to the working surface of the CMP pad.

10. The method of claim 1, wherein the vibrating is only in a direction parallel to a working surface of the CMP pad.

11. The method of claim 1, wherein the vibration is controlled by controlling either vibration frequency, amplitude or both.

12. The method of claim 1, wherein the vibrating is at an ultrasonic frequency.

13. The method of claim 12, wherein the frequency is an ultrasonic frequency greater than 15 kHz.

14. The method of claim 12, wherein a temperature measurement of at least a portion of the CMP pad is elevated by at least about 5° C. by the vibrating.

15. The method of claim 1, wherein a slurry of particles is present on the CMP pad.

16. The method of claim 15, wherein vibrations disperse particles in the slurry.

17. The method of claim 1, wherein the vibrating is continuous.

18. The method of claim 1, wherein the vibrating is diffused.

* * * * *